US011319816B2

(12) United States Patent
Dutta et al.

(10) Patent No.: US 11,319,816 B2
(45) Date of Patent: May 3, 2022

(54) TURBINE COMPONENT AND METHODS OF MAKING AND COOLING A TURBINE COMPONENT

(71) Applicant: GENERAL ELECTRIC COMPANY, Schenectady, NY (US)

(72) Inventors: Sandip Dutta, Greenville, SC (US); James Zhang, Greenville, SC (US); Gary Michael Itzel, Simpsonville, SC (US); John McConnell Delvaux, Fountain Inn, SC (US); Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 157 days.

(21) Appl. No.: 16/787,819

(22) Filed: Feb. 11, 2020

(65) Prior Publication Data

US 2020/0182067 A1 Jun. 11, 2020

Related U.S. Application Data

(63) Continuation of application No. 15/174,332, filed on Jun. 6, 2016, now Pat. No. 10,590,776.

(51) Int. Cl.
*F01D 5/18* (2006.01)
*F01D 5/14* (2006.01)
(Continued)

(52) U.S. Cl.
CPC ..... *F01D 5/186* (2013.01); *F01D 5/147* (2013.01); *F01D 5/187* (2013.01); *F01D 5/282* (2013.01);
(Continued)

(58) Field of Classification Search
CPC ..... F01D 5/186; F01D 5/147; F01D 5/282
See application file for complete search history.

(56) References Cited

U.S. PATENT DOCUMENTS 3,017,159 A 1/1962 Foster et al.
4,507,051 A 3/1985 Lesgourges et al.
(Continued)

FOREIGN PATENT DOCUMENTS

JP 2000-154701 A 6/2000
JP 2007-298024 A 11/2007
JP 2015-067902 A 4/2015

OTHER PUBLICATIONS

Extended European Search Report and Opinion issued in connection with corresponding EP Application No. 17174318.0, 8 pages, dated Oct. 6, 2017.
(Continued)

*Primary Examiner* — Eldon T Brockman
(74) *Attorney, Agent, or Firm* — McNees Wallace & Nurick LLC

(57) ABSTRACT

A turbine component includes a root and an airfoil extending from the root to a tip opposite the root. The airfoil forms a leading edge and a trailing edge portion extending to a trailing edge. A plurality of axial cooling channels in the trailing edge portion of the airfoil are arranged to permit axial flow of a cooling fluid from an interior of the turbine component at the trailing edge portion to an exterior of the turbine component at the trailing edge portion. A method of making a turbine component includes forming an airfoil having a trailing edge portion with axial cooling channels. The axial cooling channels are arranged to permit axial flow of a cooling fluid from an interior to an exterior of the turbine component at the trailing edge portion. A method of cooling a turbine component is also disclosed.

18 Claims, 5 Drawing Sheets

(51) Int. Cl.

| | |
|---|---|
| ***F01D 5/28*** | (2006.01) |
| ***F01D 9/04*** | (2006.01) |
| ***F01D 25/00*** | (2006.01) |
| ***F01D 25/12*** | (2006.01) |

(52) U.S. Cl.

CPC ..... *F01D 9/041* (2013.01); *F01D 25/005* (2013.01); *F01D 25/12* (2013.01); *F05D 2230/22* (2013.01); *F05D 2230/237* (2013.01); *F05D 2230/31* (2013.01); *F05D 2240/122* (2013.01); *F05D 2240/304* (2013.01); *F05D 2250/183* (2013.01); *F05D 2250/184* (2013.01); *F05D 2250/185* (2013.01); *F05D 2260/202* (2013.01); *F05D 2260/204* (2013.01); *F05D 2300/175* (2013.01); *F05D 2300/6033* (2013.01)

(56) References Cited

U.S. PATENT DOCUMENTS

| | | | | |
|---|---|---|---|---|
| 4,611,752 | A | 9/1986 | Jahnke | |
| 4,684,322 | A | 8/1987 | Clifford et al. | |
| 5,176,499 | A | 1/1993 | Damlis et al. | |
| 5,246,340 | A | 9/1993 | Winstanley et al. | |
| 6,099,252 | A | 8/2000 | Manning et al. | |
| 6,325,871 | B1 | 12/2001 | Burke et al. | |
| 6,514,046 | B1 * | 2/2003 | Morrison | F01D 9/02 416/229 A |
| 7,080,971 | B2 * | 7/2006 | Wilson | F01D 5/147 416/92 |
| 7,670,116 | B1 * | 3/2010 | Wilson, Jr. | F01D 5/147 416/226 |
| 7,785,071 | B1 * | 8/2010 | Liang | F01D 5/187 416/97 R |
| 7,862,299 | B1 | 1/2011 | Liang | |
| 8,015,705 | B2 * | 9/2011 | Wilson, Jr. | F01D 5/189 29/889.721 |
| 8,790,083 | B1 | 7/2014 | Liang | |
| 2005/0281673 | A1 | 12/2005 | Draper et al. | |
| 2007/0258811 | A1 | 11/2007 | Shi et al. | |
| 2009/0193657 | A1 * | 8/2009 | Wilson, Jr. | F01D 5/20 29/889.721 |
| 2010/0202873 | A1 * | 8/2010 | Andrew | F01D 17/162 415/116 |
| 2013/0108460 | A1 | 5/2013 | Szwedowicz et al. | |
| 2015/0086408 | A1 | 3/2015 | Kottilingam et al. | |
| 2015/0107266 | A1 | 4/2015 | Gustafson et al. | |

OTHER PUBLICATIONS

Wang et al., "The microstructure and mechanical properties of deposited-IN718 by selective laser melting", Journal of Alloys and Compounds, vol. 513, pp. 518-523, (2012).

* cited by examiner

TURBINE COMPONENT AND METHODS OF MAKING AND COOLING A TURBINE COMPONENT

CROSS-REFERENCE TO RELATED APPLICATIONS

This application is a continuation of co-pending U.S. Utility application Ser. No. 15/174,332, filed on Jun. 6, 2016, and entitled "TURBINE COMPONENT AND METHODS OF MAKING AND COOLING A TURBINE COMPONENT", the disclosure of which is hereby incorporated by reference in its entirety.

STATEMENT REGARDING FEDERALLY SPONSORED RESEARCH

This invention was made with Government support under contract number DE-FE0024006 awarded by the Department of Energy. The Government has certain rights in the invention.

FIELD OF THE INVENTION

The present embodiments are directed to methods and devices for cooling the trailing edge of a turbine airfoil. More specifically, the present embodiments are directed to methods and devices providing cooling along the trailing edge portion of a turbine component by axial cooling channels and/or film cooling.

BACKGROUND OF THE INVENTION

Modern high-efficiency combustion turbines have firing temperatures that exceed about 2000° F. (1093° C.), and firing temperatures continue to increase as demand for more efficient engines continues. Gas turbine components, such as nozzles and blades, are subjected to intense heat and external pressures in the hot gas path. These rigorous operating conditions are exacerbated by advances in the technology, which may include both increased operating temperatures and greater hot gas path pressures. As a result, components, such as nozzles and blades, are sometimes cooled by flowing a fluid through a manifold inserted into the core of the nozzle or blade, which exits the manifold through impingement holes into a post-impingement cavity, and which then exits the post-impingement cavity through apertures in the exterior wall of the nozzle or blade, in some cases forming a film layer of the fluid on the exterior of the nozzle or blade.

The cooling of the trailing edge of a turbine airfoil is important to prolong its integrity in the hot furnace-like environment. While turbine airfoils are often made primarily of a nickel-based or a cobalt-based superalloy, turbine airfoils may alternatively have an outer portion made of one or more ceramic matrix composite (CMC) materials. CMC materials are generally better at handling higher temperatures than metals. Certain CMC materials include compositions having a ceramic matrix reinforced with coated fibers. The composition provides strong, lightweight, and heat-resistant materials with possible applications in a variety of different systems. The materials from which turbine components, such as nozzles and blades, are formed, combined with the particular conformations which the turbine components include, lead to certain inhibitions in the cooling efficacy of the cooling fluid systems. Maintaining a substantially uniform temperature of a turbine airfoil maximizes the useful life of the airfoil.

The manufacture of a CMC part typically includes laying up pre-impregnated composite fibers having a matrix material already present (prepreg) to form the geometry of the part (pre-form), autoclaving and burning out the pre-form, infiltrating the burned-out pre-form with the melting matrix material, and any machining or further treatments of the pre-form. Infiltrating the pre-form may include depositing the ceramic matrix out of a gas mixture, pyrolyzing a pre-ceramic polymer, chemically reacting elements, sintering, generally in the temperature range of 925 to 1650° C. (1700 to 3000° F.), or electrophoretically depositing a ceramic powder. With respect to turbine airfoils, the CMC may be located over a metal spar to form only the outer surface of the airfoil.

Examples of CMC materials include, but are not limited to, carbon-fiber-reinforced carbon (C/C), carbon-fiber-reinforced silicon carbide (C/SiC), silicon-carbide-fiber-reinforced silicon carbide (SiC/SiC), alumina-fiber-reinforced alumina ($Al_2O_3/Al_2O_3$), or combinations thereof. The CMC may have increased elongation, fracture toughness, thermal shock, dynamic load capability, and anisotropic properties as compared to a monolithic ceramic structure.

BRIEF DESCRIPTION OF THE INVENTION

In an embodiment, a turbine component includes a root and an airfoil extending from the root to a tip opposite the root. The airfoil forms a leading edge and a trailing edge portion extending to a trailing edge. A plurality of axial cooling channels in the trailing edge portion of the airfoil are arranged to permit axial flow of a cooling fluid from an interior of the turbine component at the trailing edge portion to an exterior of the turbine component at the trailing edge portion.

In another embodiment, a method of making a turbine component includes forming an airfoil having a leading edge, a trailing edge portion extending to a trailing edge, and a plurality of axial cooling channels in the trailing edge portion. The axial cooling channels are arranged to permit axial flow of a cooling fluid from an interior of the turbine component at the trailing edge portion to an exterior of the turbine component at the trailing edge portion. The axial cooling channels fluidly connect an interior of the turbine component at the trailing edge portion with an exterior of the turbine component at the trailing edge portion.

In another embodiment, a method of cooling a turbine component includes supplying a cooling fluid to an interior of the turbine component. The turbine component includes a root and an airfoil extending from the root to a tip opposite the root. The airfoil forms a leading edge and a trailing edge portion extending to a trailing edge. The trailing edge portion has a plurality of axial cooling channels arranged to permit axial flow of the cooling fluid from an interior of the turbine component at the trailing edge portion to an exterior of the turbine component at the trailing edge portion. The method also includes directing the cooling fluid through the axial cooling channels through the trailing edge portion of the airfoil. Each axial cooling channel fluidly connects the interior of the turbine component at the trailing edge portion with an exterior of the turbine component at the trailing edge portion.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a method and a device for cooling the trailing edge of a turbine component airfoil with axial cooling channels and/or film cooling along the trailing edge portion of the airfoil.

Embodiments of the present disclosure, for example, in comparison to concepts failing to include one or more of the features disclosed herein, provide cooling in a turbine airfoil, provide a more uniform temperature in a cooled turbine airfoil, provide a turbine airfoil with an enhanced lifespan, provide film cooling of a turbine airfoil, or combinations thereof.

As used herein, axial refers to orientation directionally between a first surface, such as interior surface 52 of the trailing edge portion, and a second surface, such as the outer surface of the trailing edge portion.

As used herein, a trailing edge portion refers to a portion of an airfoil at the trailing edge without chambers or other void space aside from the cooling channels formed therein as described herein.

Figure 1:
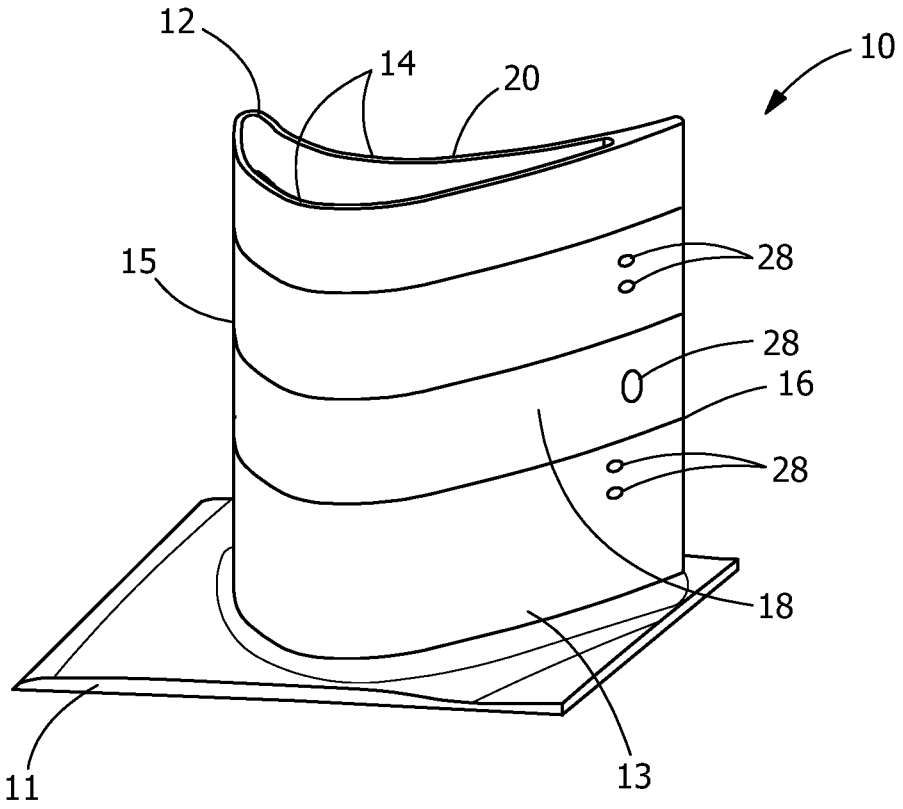
FIG. 1 is a schematic perspective side view of a turbine component in an embodiment of the present disclosure.

Referring to FIG. 1, a turbine component 10 includes a root 11 and an airfoil 12 extending from the root 11 at the base 13 to a tip 14 opposite the base 13. In some embodiments, the turbine component 10 is a turbine nozzle. In some embodiments, the turbine component 10 is a turbine blade. The shape of the airfoil 12 includes a leading edge 15, a trailing edge 16, a suction side 18 having a convex outer surface, and a pressure side 20 having a concave outer surface opposite the convex outer surface. Although not shown in FIG. 1, the turbine component 10 may also include an outer sidewall at the tip 14 of the airfoil 12 similar to the root 11 at the base 13 of the airfoil 12.

Figure 2:
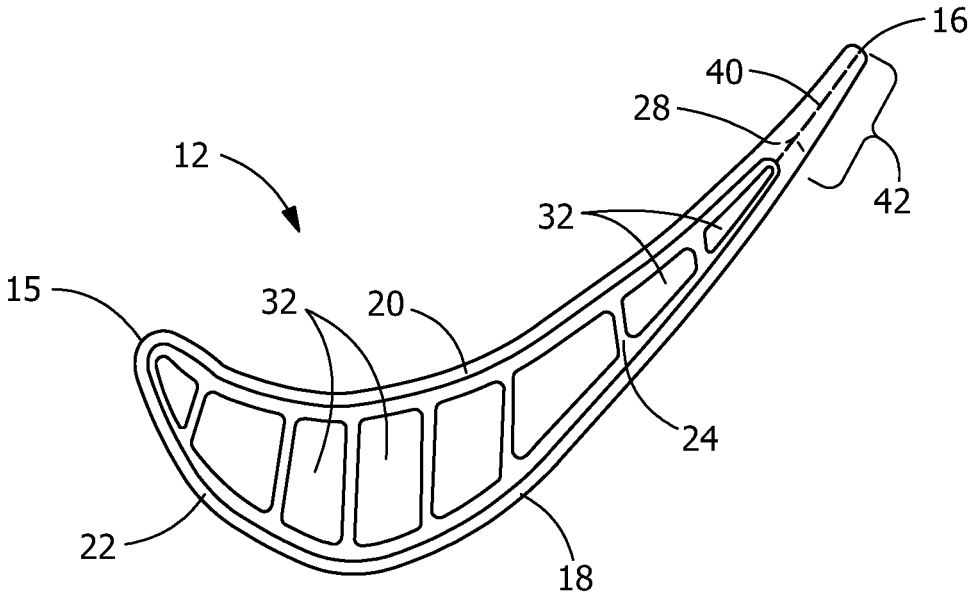
FIG. 2 is a schematic top view of the turbine component of FIG. 1 with a CMC outer layer.
Figure 3:
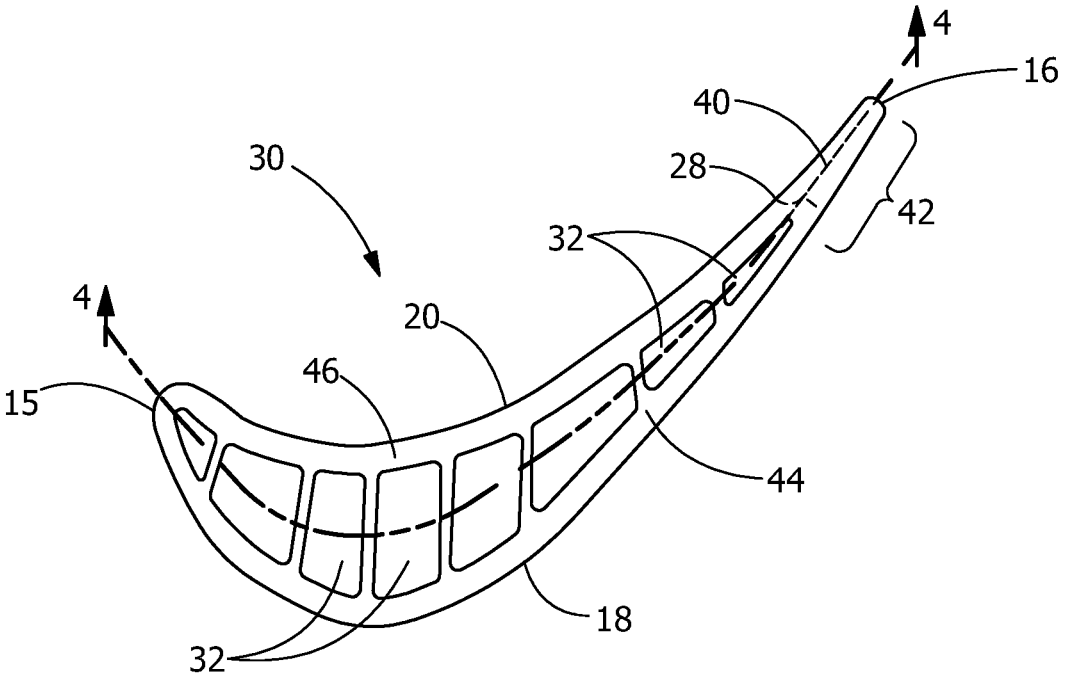
FIG. 3 is a schematic top view of the turbine component of FIG. 1 as a metal airfoil.

The generally arcuate contour of the airfoil 12 is shown more clearly in FIG. 2 and FIG. 3. The film cooling regions 28 may be on the suction side 18 of the airfoil 12, the pressure side 20 of the airfoil 12, or both sides of the airfoil 12. Referring to FIG. 2, the airfoil 12 includes a ceramic matrix composite (CMC) shell 22 mounted on a metal spar 24. The airfoil 12 is formed as a thin CMC shell 22 of one or more layers of CMC materials over the metal spar 24. Referring to FIG. 3, the airfoil 12 is alternatively formed as a metal part 30. The metal part is preferably a high-temperature superalloy. In some embodiments, the high-temperature superalloy is a nickel-based high-temperature superalloy or a cobalt-based high-temperature superalloy.

In either case, the axial cooling channels 40 in the trailing edge portion 42 permit a cooling fluid supplied to the inner portion of the airfoil 12 to flow through the trailing edge portion 42 and out of the trailing edge portion 42 during operation of a turbine including the turbine component 10. The airfoil 12 includes one or more chambers 32 to which cooling fluid may be provided by way of the root 11 or by way of the tip 14 of the turbine component 10.

Figure 4:
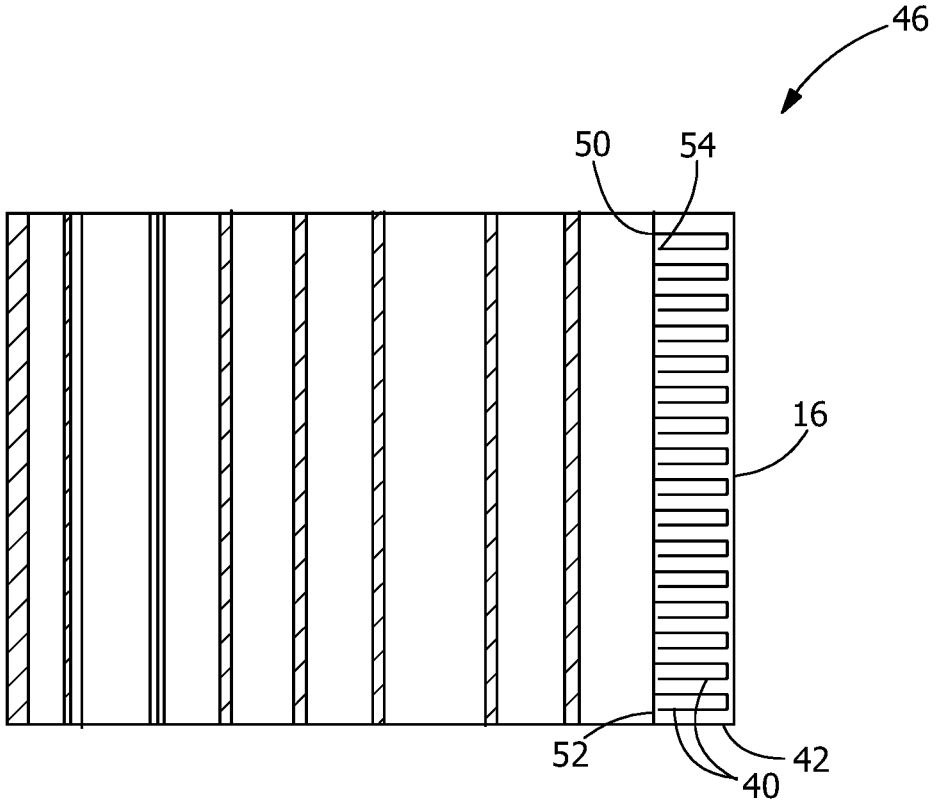
FIG. 4 is a schematic partial cross sectional view taken along line 4-4 of FIG. 3.

Referring to FIG. 4, the trailing edge portion 42 of the turbine component 10 includes the axial cooling channels 40 that open at a first end 50 at an interior surface 52 and a second end 54 opposite the first end 50 either at a film cooling region 28 in the side of the airfoil 12 or at or near the trailing edge 16 of the airfoil 12 to provide passage of a cooling fluid in a generally axial direction from the interior to the exterior of the turbine component 10.

Figure 5:
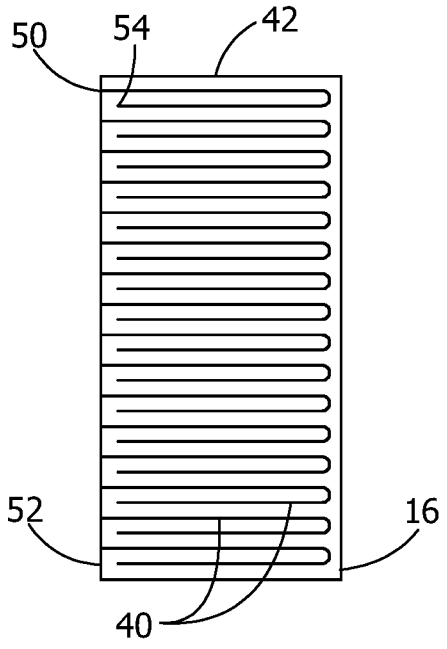
FIG. 5 is a schematic partial cross sectional view of the trailing edge portion of the turbine component of FIG. 1 showing an axial serpentine cooling channel arrangement with film cooling in an embodiment of the present disclosure.
Figure 6:
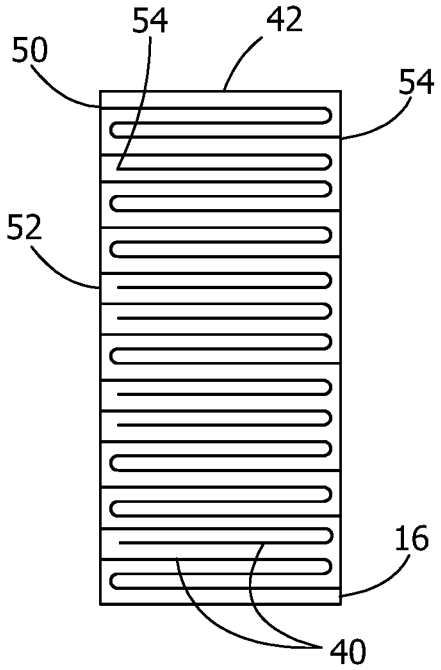
FIG. 6 is a schematic partial cross sectional view of the trailing edge portion of the turbine component of FIG. 1 showing an axial serpentine cooling channel arrangement with partial film cooling in an embodiment of the present disclosure.
Figure 7:
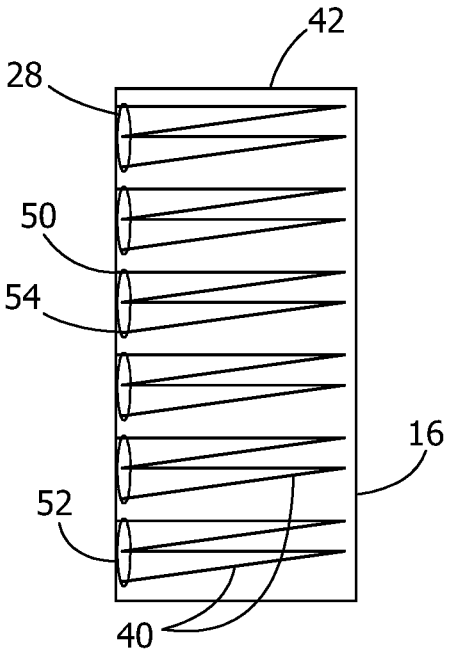
FIG. 7 is a schematic partial cross sectional view of the trailing edge portion of the turbine component of FIG. 1 showing an axial zigzag cooling channel arrangement with film cooling in an embodiment of the present disclosure.
Figure 8:
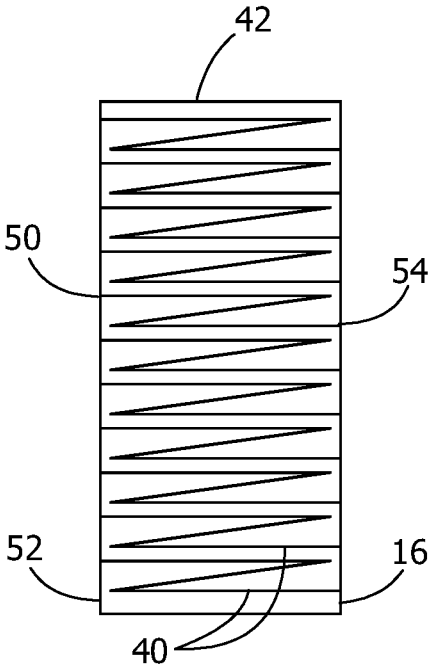
FIG. 8 is a schematic partial cross sectional view of the trailing edge portion of the turbine component of FIG. 1 showing an axial zigzag cooling channel arrangement without film cooling in an embodiment of the present disclosure.
Figure 9:
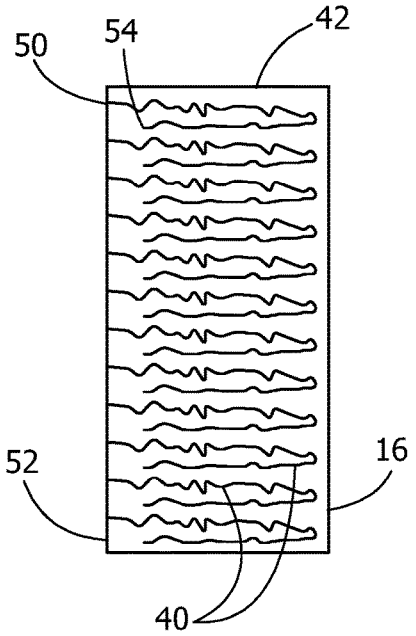
FIG. 9 is a schematic partial cross sectional view of the trailing edge portion of the turbine component of FIG. 1 showing an axial irregular cooling channel arrangement with film cooling in an embodiment of the present disclosure.
Figure 10:
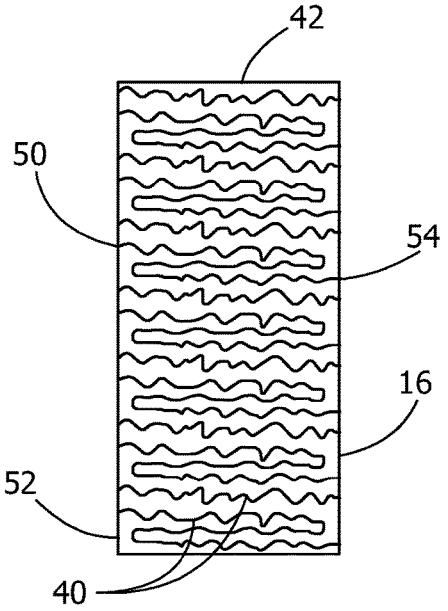
FIG. 10 is a schematic partial cross sectional view of the trailing edge portion of the turbine component of FIG. 1 showing an axial irregular cooling channel arrangement without film cooling in an embodiment of the present disclosure.

The axial cooling channels 40 in the trailing edge portion 42 may have any axial contour, including, but not limited to, a serpentine contour as shown in FIG. 5 and FIG. 6, a zigzag contour as shown in FIG. 7 and FIG. 8, an irregular contour as shown in FIG. 9 and FIG. 10, or combinations thereof. An irregular contour may be any non-repeating contour, such as, for example, a random contour.

The axial cooling channels 40 open at a first end 50 at an interior surface 52. Referring to FIG. 5, FIG. 7, and FIG. 9, the axial cooling channels 40 open at a second end 54 opposite the first end 50 at a film cooling region 28 in the side of the airfoil 12. Referring to FIG. 6, some of the axial cooling channels 40 open at a second end 54 at a film cooling region 28 in the side of the airfoil 12, while the other axial cooling channels 40 open at a second end 54 at or near the trailing edge 16 of the airfoil 12. Referring to FIG. 8 and FIG. 10, the axial cooling channels 40 open at a second end 54 opposite the first end 50 at or near the trailing edge 16 of the airfoil 12.

Figure 11:
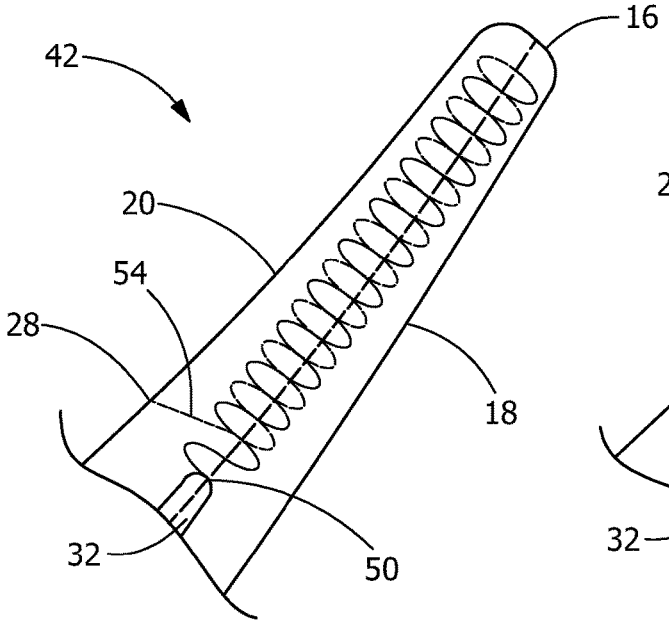
FIG. 11 is a top schematic partial cross sectional view of the trailing edge portion of the turbine component of FIG. 1 showing an axial cooling channel with axial waviness and film cooling on the pressure side in an embodiment of the present disclosure.
Figure 12:
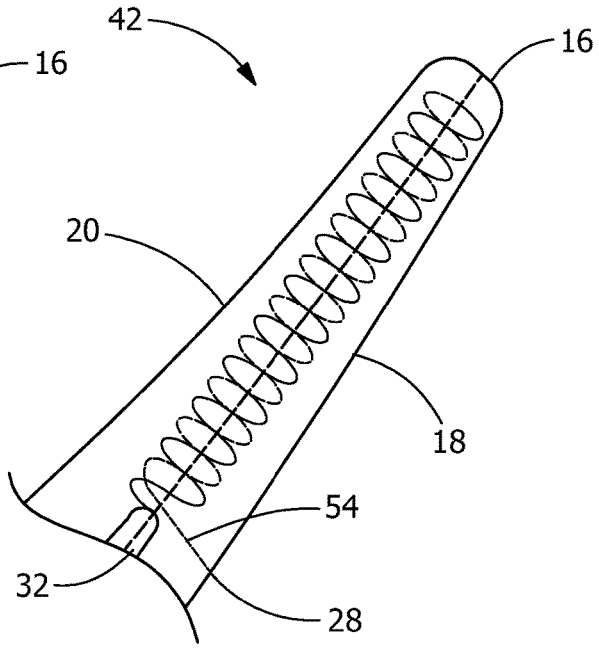
FIG. 12 is a top schematic partial cross sectional view of the trailing edge portion of the turbine component of FIG. 1 showing an axial cooling channel with axial waviness and film cooling on the suction side in an embodiment of the present disclosure.

In addition to a serpentine, zigzag, or irregular contour in a radial plane, the axial cooling channels 40 may have a nonlinear contour in the axial plane, such as the wavy contour shown in FIG. 11 and FIG. 12, a zigzag contour, or an irregular contour, each of which varies the distance between the axial cooling channel 40 and the suction side 18 surface or the pressure side 20 surface along the axial cooling channel 40 pathway. The formation of the airfoil 12 from two sections 44, 46 permits formation of axial cooling channels 40 with complex contours.

When the airfoil 12 includes a CMC shell 22, at least a portion of the axial cooling channels 40 may be formed between layers of the CMC material. It is expected that the trailing edge of the CMC shell 22 of a turbine airfoil 12 gets hot and cooling may be necessary to preserve the structural integrity. In some embodiments, all of the axial cooling channels 40 are formed between CMC layers. In some embodiments, the axial cooling channels 40 are formed by machining the CMC material after formation of the CMC material. In other embodiments, a sacrificial material is burned or pyrolyzed out either during or after formation of the CMC material to form the axial cooling channels 40.

When the airfoil 12 is formed as a metal part 30, the metal part 30 may be formed by casting or alternatively by metal three-dimensional (3D) printing. In some embodiments, the metal part 30 is formed as two metal pieces that are brazed or welded together, such as, for example, along line 4-4 of FIG. 3. In such embodiments, the two pieces are a first section 44 including the suction side 18 having the convex outer surface and a second section 46 including the pressure side 20 having the concave outer surface, with at least a portion of the axial cooling channels 40 being formed at one or both of the surfaces of the sections 44, 46. In some embodiments, all of the axial cooling channels 40 are formed at the surface of the sections 44, 46. In other embodiments, the metal part 30 may be formed as a single piece by metal 3D printing. In some embodiments, at least a portion of the axial cooling channels 40 is formed by machining the metal part 30.

Metal 3D printing enables precise creation of a turbine component 10 including complex axial cooling channels 40. In some embodiments, metal 3D printing forms successive layers of material under computer control to create at least a portion of the turbine component 10. In some embodiments, powdered metal is heated to melt or sinter the powder to the growing turbine component 10. Heating methods may include, but are not limited to, selective laser sintering (SLS), direct metal laser sintering (DMLS), selective laser melting (SLM), electron beam melting (EBM), and combinations thereof. In some embodiments, a 3D metal printer lays down metal powder, and then a high-powered laser melts that powder in certain predetermined locations based on a model from a computer-aided design (CAD) file. Once one layer is melted and formed, the 3D printer repeats the process by placing additional layers of metal powder on top of the first layer, or where otherwise instructed, one at a time, until the entire metal component is fabricated.

The axial cooling channels 40 are preferably formed in the trailing edge portion 42 of the airfoil 12 to permit passage of a cooling fluid to cool the trailing edge portion 42. The axial cooling channels 40 may have any axial contour, including, but not limited to, serpentine, zigzag, irregular, or combinations thereof. In some embodiments, the dimensions, contours, and/or locations of the axial cooling channels 40 are selected to permit cooling that maintains a substantially uniform temperature in the trailing edge portion 42 during operation of a turbine including the turbine component 10.

In some embodiments, the axial cooling channels 40 are aligned as serpentine passages. The serpentine passages include longer length in a small space. In some embodiments, the axial cooling channels 40 have an axial zigzag path and may come back and fill a film trench at a film cooling region 28 to enhance cooling. In some embodiments, the cross section of the axial cooling channel 40 varies to provide more uniform cooling through the length of the axial cooling channel 40.

The cooling fluid comes from the inside of the airfoil 12 and exits after traveling axially and cooling through the axial cooling channels 40 in the trailing edge portion 42. The spent cooling fluid may be used as a film cooling fluid exiting a film cooling region 28.

In some embodiments, the second end 54 of the axial cooling channel 40 opens to a film cooling region 28 that is much wider than the axial cooling channel 40, as shown in FIG. 7. The axial cooling channel 40 makes multiple passes in the axial direction through the trailing edge portion 42 and the film cooling region 28 is preferably at least as wide in the radial direction as the radial distance between two passes of the axial cooling channel 40. In such embodiments, the axial cooling channels 40 significantly reduce the pressure ratio across the film cooling region 28, thereby enabling less flow per film cooling region 28 and better coverage. In some embodiments, the blowing ratio across the film cooling region 28 is tuned to optimize film effectiveness. In some embodiments, the axial cooling channels 40 are designed to maximize the convection efficiency of the cooling fluid flow to provide the spent cooling fluid as a film. In some embodiments, maximum convection coverage is provided for minimum cooling flow.

Figure 13:
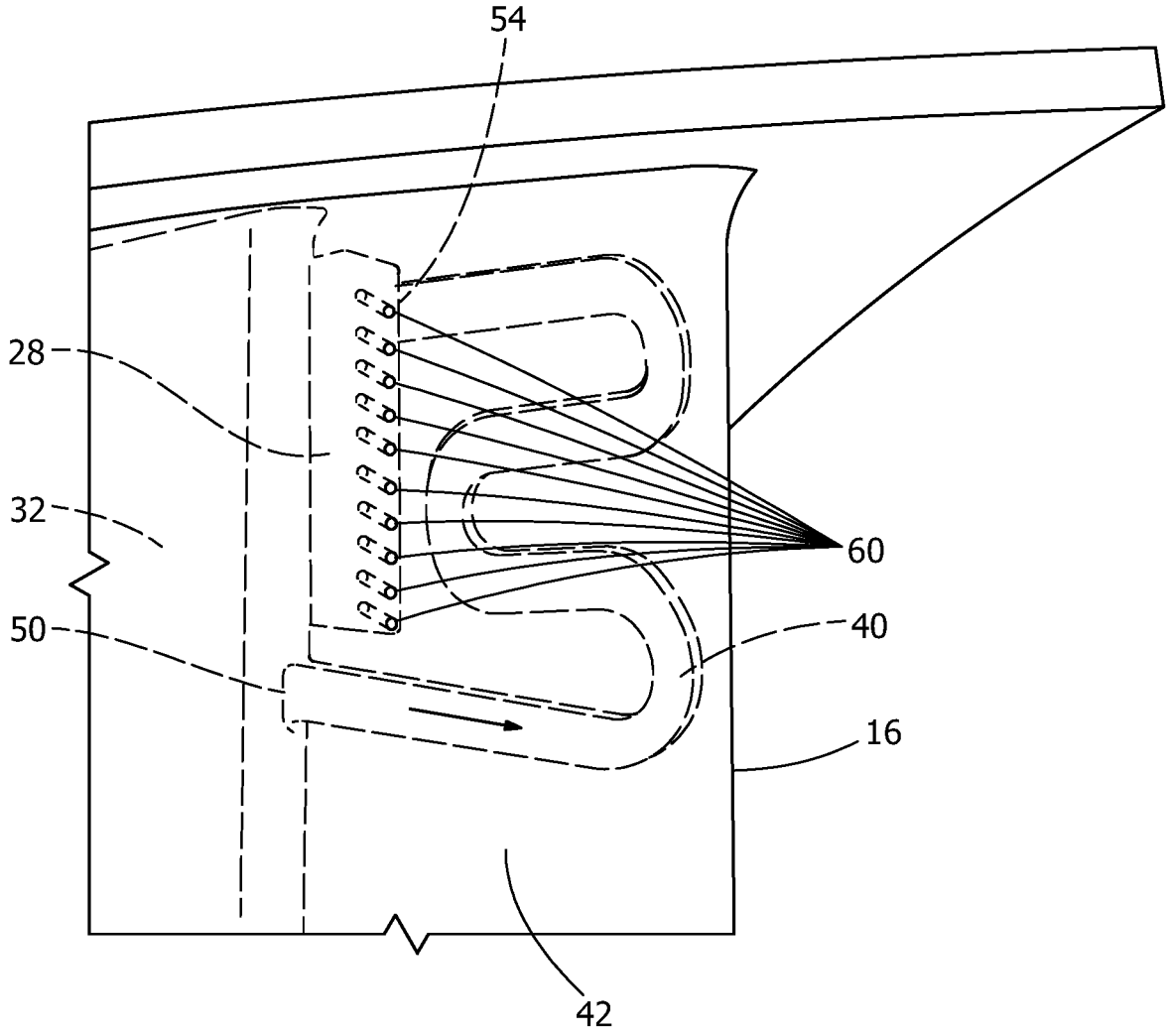
FIG. 13 is a side schematic partial transparent view of the trailing edge portion of the turbine component of FIG. 5 showing an axial serpentine cooling channel arrangement with film cooling.

The film cooling region 28 supplied by the second end 54 of an axial cooling channel 40 may include a single film cooling hole 60 or multiple film cooling holes 60, as shown in FIG. 13. The film cooling holes 60 are preferably small and may have a size and contour that promote boundary layer flow of cooling fluid from the film cooling holes 60 along the outer surface of the airfoil 12. The film cooling region 28 may cover the spread of the axial cooling channel 40 and provide a blanket of cooling film covering the entire radial distance serviced by the axial cooling channel 40 or the entire radial distance other than the first pass, as shown in FIG. 13. Starting as fresh coolant entering the axial cooling channel 40, the cooling fluid is coolest in this first pass (indicated by an arrow in FIG. 13), this region of the trailing edge portion 42 is least in need of the cooling film.

In some embodiments, the axial cooling channels 40 are provided in a CMC material, where less cooling effectiveness is needed and reduced flow is sufficient. In some embodiments, the cross sectional flow area along the serpentine, zigzag, or irregular contour is varied as the cooling fluid picks up heat to maintain a constant cooling effectiveness along the axial cooling channel 40.

In some embodiments, the dimensions, contours, and/or locations of the axial cooling channels 40 and/or film cooling regions 28 are selected to permit cooling that maintains a substantially uniform temperature in the trailing edge portion 42 during operation of a turbine including the turbine component 10. The cross section of an axial cooling channel 40 may have any shape, including, but not limited to, a round shape, an elliptical shape, a racetrack shape, and a parallelogram. The size and shape of the cross section of the axial cooling channel 40 may vary from the first end 50 to the second end 54, depending on the local cooling effectiveness required of the axial cooling channel 40. In some embodiments, the axial cooling channel 10 tapers from the second end 54 to the first end 50 to maintain a substantially constant cooling effectiveness as the cooling fluid picks up heat along the axial cooling channel 10.

The film cooling regions 28 are preferably formed at or near the upstream end or the trailing edge portion 42 away from the trailing edge 16. The film cooling regions 28 are preferably contoured to direct spent cooling fluid along the outer surface of the trailing edge portion 42 to form a boundary layer between the hot gas path flow and the outer surface, thereby reducing the heat exposure of the outer surface.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A turbine component comprising:

a root; and an airfoil extending from the root to a tip opposite the root, the airfoil comprising a metal spar and a shell over the metal spar, the shell comprising a ceramic matrix composite material, the airfoil forming a leading edge, a trailing edge portion extending to a trailing edge, a suction side, and a pressure side opposite the suction side;

wherein a plurality of axial cooling channels in the trailing edge portion of the airfoil are arranged to permit axial flow of a cooling fluid through the trailing edge portion from an interior of the turbine component at the trailing edge portion to an exterior of the turbine component at the trailing edge portion, and wherein at least one of the plurality of axial cooling channels makes a plurality of passes in an axial direction through the trailing edge portion.

2. The turbine component of claim 1, wherein the at least one of the plurality of axial cooling channels exits the suction side or the pressure side of the trailing edge portion as a cooling film at a film cooling region.

3. The turbine component of claim 2, wherein the film cooling region includes a plurality of film cooling holes directing the cooling film to form a boundary layer along an outer surface of the airfoil.

4. The turbine component of claim 1, wherein at least a portion of the plurality of axial cooling channels are formed between layers of the ceramic matrix composite material.

5. The turbine component of claim 1, wherein the plurality of axial cooling channels has a geometry extending radially through the airfoil selected from the group consisting of serpentine, zigzag, irregular, and combinations thereof.

6. The turbine component of claim 1, wherein the plurality of axial cooling channels has a geometry extending axially through the airfoil selected from the group consisting of straight, wavy, zigzag, and irregular.

7. A method of making a turbine component comprising:

forming an airfoil, the airfoil comprising a metal spar and a shell over the metal spar, the shell comprising a ceramic matrix composite material, the airfoil having a leading edge, a trailing edge portion extending to a trailing edge, a suction side, a pressure side opposite the suction side, and a plurality of axial cooling channels in the trailing edge portion, the plurality of axial cooling channels being arranged to permit axial flow of a cooling fluid through the trailing edge portion from an interior of the turbine component at the trailing edge portion to an exterior of the turbine component at the trailing edge portion, thereby fluidly connecting the interior of the turbine component at the trailing edge portion with the exterior of the turbine component at the trailing edge portion;

wherein at least one of the plurality of axial cooling channels makes a plurality of passes in an axial direction through the trailing edge portion.

8. The method of claim 7, wherein the forming comprises forming a film cooling region including at least one film cooling hole in the suction side or the pressure side in the trailing edge portion at an exit of at least one of the plurality of axial cooling channels.

9. The method of claim 7, wherein the forming the airfoil further comprises forming the shell comprising the ceramic matrix composite material.

10. The method of claim 9, wherein the forming the airfoil further comprises forming the metal spar, the shell being formed over the metal spar to form the airfoil.

11. The method of claim 7, further comprising forming at least a portion of the plurality of axial cooling channels between layers of the ceramic matrix composite material.

12. The method of claim 7, further comprising forming the plurality of axial cooling channels by machining the ceramic matrix composite material after formation of the ceramic matrix composite material.

13. The method of claim 7, further comprising forming the ceramic matrix composite material to include a sacrificial material and burning or pyrolyzing out the sacrificial material either during or after forming the ceramic matrix composite material to form the plurality of axial cooling channels.

14. The method of claim 7, wherein the plurality of axial cooling channels has a geometry extending axially through the airfoil selected from the group consisting of serpentine, zigzag, irregular, and combinations thereof.

15. A method of cooling a turbine component comprising:

supplying a cooling fluid to an interior of the turbine component, the turbine component comprising:

a root; and an airfoil extending from the root to a tip opposite the root, the airfoil comprising a metal spar and a shell over the metal spar, the shell comprising a ceramic matrix composite material, the airfoil forming a leading edge, a trailing edge portion extending to a trailing edge, a suction side, and a pressure side opposite the suction side, the trailing edge portion having a plurality of axial cooling channels arranged to permit axial flow of the cooling fluid through the trailing edge portion from an interior of the turbine component at the trailing edge portion to an exterior of the turbine component at the trailing edge portion, wherein at least one of the plurality of axial cooling channels makes a plurality of passes in an axial direction through the trailing edge portion; and directing the cooling fluid through the plurality of axial cooling channels through the trailing edge portion of the airfoil, each of the plurality of axial cooling channels fluidly connecting the interior of the turbine component at the trailing edge portion with the exterior of the turbine component at the trailing edge portion.

16. The method of claim 15, wherein the directing further comprises directing the cooling fluid from at least one of the plurality of axial cooling channels through a film cooling hole in the suction side or the pressure side in the trailing edge portion.

17. The method of claim 15 further comprising operating a turbine comprising the turbine component.

18. The method of claim 15, wherein each axial cooling channel of the plurality of axial cooling channels has a geometry extending axially through the airfoil selected from the group consisting of serpentine, zigzag, irregular, and combinations thereof.

* * * * *